US006904707B2

(12) United States Patent
McMullin

(10) Patent No.: US 6,904,707 B2
(45) Date of Patent: Jun. 14, 2005

(54) INDEXABLE SHOE CLEAT WITH IMPROVED TRACTION

(75) Inventor: Faris W. McMullin, Boise, ID (US)

(73) Assignee: Softspikes, LLC, Gaithersburg, MD (US)

( * ) Notice: Subject to any disclaimer, the term of this patent is extended or adjusted under 35 U.S.C. 154(b) by 0 days.

(21) Appl. No.: 10/609,682

(22) Filed: Jul. 1, 2003

(65) Prior Publication Data

US 2005/0000118 A1 Jan. 6, 2005

(51) Int. Cl.[7] ..... A43C 15/02
(52) U.S. Cl. ..... 36/127; 36/134
(58) Field of Search ..... 36/134, 67 D, 36/67 A, 127, 59 C, 59 R

(56) References Cited

U.S. PATENT DOCUMENTS

| | | | |
|---|---|---|---|
| 39,575 | A | 8/1863 | Hyatt et al. |
| 180,578 | A | 8/1876 | Gunsalus |
| 416,861 | A | 12/1889 | Scafe |

(Continued)

FOREIGN PATENT DOCUMENTS

| | | | |
|---|---|---|---|
| CA | 2231216 | | 9/1998 |
| DE | 156642 | | 11/1904 |
| DE | 185659 | | 6/1907 |
| DE | 2529027 | A1 | 1/1977 |
| DE | 2540426 | | 3/1977 |
| DE | 3438060 | A1 | 6/1985 |
| DE | 4316650 | A1 | 11/1993 |
| EP | 1263960 | | 2/1972 |
| EP | 1378461 | | 12/1974 |
| EP | 1434282 | | 5/1976 |
| EP | 1587382 | | 4/1981 |
| EP | 0153136 | A2 | 8/1985 |
| EP | 0342232 | A1 | 11/1989 |
| EP | 0363217 | A2 | 4/1990 |
| EP | 0524861 | A1 | 1/1993 |
| FR | 493748 | | 8/1919 |
| FR | 807754 | | 1/1937 |
| GB | 2814 | | 7/1914 |
| GB | 401979 | | 11/1933 |
| GB | 2044731 | A | 4/1979 |
| GB | 2053658 | A | 2/1981 |
| GB | 2223394 | | 4/1990 |
| GB | 2248762 | A | 4/1992 |
| GB | 2266223 | A | 10/1993 |
| GB | 2322787 | A | 9/1998 |
| IT | 467815 | | 12/1951 |
| JP | 57-30003 | | 7/1980 |
| JP | 3-27022 | | 5/1996 |
| JP | 9-168405 | | 6/1997 |
| JP | 11-264870 | | 9/1999 |

(Continued)

OTHER PUBLICATIONS

Softspikes, Inc., advertisement, *Golf Digest*, Dec. 1996, p. 149.

*Primary Examiner*—Ted Kavanaugh
(74) *Attorney, Agent, or Firm*—Edell, Shapiro & Finnan, LLC

(57) ABSTRACT

A shoe cleat with improved traction includes a hub with an exposed surface facing away from the shoe sole when the cleat is secured to the shoe, at least one traction element extending from the hub in a direction away from the exposed surface of the hub, and a cleat connector extending from a surface of the hub opposing the exposed surface and securable within a receptacle of the shoe. The cleat connector is positioned on the hub such that the radial distance defined between the hub perimeter and a central axis of the cleat connector differs at varying locations along the hub perimeter in order to facilitate different orientations of the hub with respect to the shoe sole when the cleat is secured to the shoe.

18 Claims, 4 Drawing Sheets

U.S. PATENT DOCUMENTS

| | | | | |
|---|---|---|---|---|
| 485,459 | A | | 11/1892 | Crocker |
| 962,719 | A | | 6/1910 | Pratt |
| 982,278 | A | | 1/1911 | Kline |
| 1,093,358 | A | | 4/1914 | Schroeder |
| 1,243,209 | A | | 10/1917 | Park |
| 1,304,616 | A | | 5/1919 | Smith |
| 1,355,827 | A | | 10/1920 | Finneran |
| 1,422,716 | A | | 7/1922 | Jones |
| 1,749,351 | A | | 3/1930 | McQueen |
| 1,876,195 | A | | 9/1932 | Youmans |
| 2,258,805 | A | | 10/1941 | Phillips |
| 2,336,632 | A | | 12/1943 | Park |
| 2,491,596 | A | | 12/1949 | Zaleski et al. |
| 2,745,197 | A | | 5/1956 | Holt |
| 2,803,070 | A | | 8/1957 | Passidomo et al. |
| 2,844,833 | A | | 7/1958 | Odermatt |
| 2,895,235 | A | | 7/1959 | Melchiona |
| 3,352,034 | A | * | 11/1967 | Braun ..... 36/67 D |
| 3,487,563 | A | | 1/1970 | Austin |
| 3,512,275 | A | | 5/1970 | Leavitt |
| 3,559,310 | A | | 2/1971 | Kiela |
| 3,561,140 | A | | 2/1971 | Ludwig |
| 3,583,082 | A | | 6/1971 | Jordan, Jr. |
| 3,583,083 | A | | 6/1971 | Drew |
| 3,656,245 | A | | 4/1972 | Wilson |
| 3,672,077 | A | | 6/1972 | Coles |
| 3,747,238 | A | | 7/1973 | Jankauskas |
| 3,766,670 | A | | 10/1973 | Nakajima |
| 3,818,617 | A | | 6/1974 | Dassler et al. |
| 3,859,739 | A | | 1/1975 | Dassler |
| 3,890,725 | A | | 6/1975 | Lea et al. |
| 4,014,114 | A | | 3/1977 | Jordan et al. |
| 4,141,158 | A | | 2/1979 | Benseler et al. |
| 4,180,923 | A | | 1/1980 | Dassler |
| 4,205,466 | A | | 6/1980 | Collins |
| 4,233,759 | A | | 11/1980 | Bente et al. |
| 4,299,038 | A | | 11/1981 | Epple |
| 4,309,376 | A | | 1/1982 | Ueno et al. |
| 4,330,950 | A | | 5/1982 | Reddien |
| 4,366,632 | A | | 1/1983 | Bente |
| 4,375,728 | A | | 3/1983 | Dassler |
| 4,392,312 | A | | 7/1983 | Crowley et al. |
| 4,492,047 | A | | 1/1985 | Arff |
| 4,521,979 | A | | 6/1985 | Blaser |
| 4,527,345 | A | | 7/1985 | Lopez |
| 4,571,852 | A | | 2/1986 | Lamarche et al. |
| 4,587,748 | A | | 5/1986 | Collins |
| 4,633,600 | A | | 1/1987 | Dassler et al. |
| D288,262 | S | | 2/1987 | Yokoishi |
| 4,689,901 | A | | 9/1987 | Ihlenburg |
| 4,723,366 | A | | 2/1988 | Hagger |
| 4,727,661 | A | | 3/1988 | Kuhn |
| 4,777,738 | A | | 10/1988 | Giese et al. |
| 4,782,604 | A | | 11/1988 | Wen-Shown |
| 4,833,796 | A | | 5/1989 | Flemming |
| 4,837,949 | A | | 6/1989 | Dufour |
| 4,885,851 | A | | 12/1989 | Peterson |
| 5,029,405 | A | | 7/1991 | DeHaitre |
| 5,033,211 | A | | 7/1991 | Latraverse et al. |
| D320,882 | S | | 10/1991 | Collins |
| 5,070,631 | A | | 12/1991 | Fenton |
| 5,077,916 | A | | 1/1992 | Beneteau |
| D327,975 | S | | 7/1992 | Saito et al. |
| D341,479 | S | | 11/1993 | Saito et al. |
| D341,480 | S | | 11/1993 | Saito et al. |
| D341,704 | S | | 11/1993 | Saito et al. |
| D341,705 | S | | 11/1993 | Saito et al. |
| 5,259,129 | A | | 11/1993 | Deacon et al. |
| D341,938 | S | | 12/1993 | Saito et al. |
| D342,151 | S | | 12/1993 | Saito et al. |
| D342,152 | S | | 12/1993 | Saito et al. |
| D342,373 | S | | 12/1993 | Saito et al. |
| 5,367,793 | A | | 11/1994 | Deacon et al. |
| 5,483,760 | A | | 1/1996 | Kataoka et al. |
| D371,453 | S | | 7/1996 | Deacon et al. |
| D371,895 | S | | 7/1996 | McMullin |
| D371,896 | S | | 7/1996 | McMullin |
| 5,533,282 | A | | 7/1996 | Kataoka et al. |
| D372,355 | S | | 8/1996 | Deacon et al. |
| D373,675 | S | | 9/1996 | McMullin |
| D378,013 | S | | 2/1997 | McMullin |
| 5,623,774 | A | | 4/1997 | Abbey |
| D380,076 | S | | 6/1997 | McMullin |
| D385,988 | S | | 11/1997 | McMullin |
| D387,548 | S | | 12/1997 | McMullin |
| D389,299 | S | | 1/1998 | McMullin |
| D390,693 | S | | 2/1998 | Curley, Jr. |
| 5,761,833 | A | | 6/1998 | McMullin |
| 5,791,071 | A | | 8/1998 | Rosdail |
| 5,794,367 | A | | 8/1998 | Carroll |
| D401,046 | S | | 11/1998 | McMullin |
| D404,192 | S | | 1/1999 | McMullin |
| 5,887,371 | A | | 3/1999 | Curley, Jr. |
| D407,893 | S | | 4/1999 | McMullin |
| D408,122 | S | | 4/1999 | McMullin |
| D409,463 | S | | 5/1999 | McMullin |
| 5,901,472 | A | | 5/1999 | Adam |
| D415,340 | S | | 10/1999 | McMullin |
| D416,673 | S | * | 11/1999 | Menke ..... D2/962 |
| 5,974,700 | A | | 11/1999 | Kelly |
| 6,009,640 | A | | 1/2000 | Deacon et al. |
| 6,023,860 | A | | 2/2000 | McMullin |
| 6,041,526 | A | | 3/2000 | Collins |
| 6,052,923 | A | | 4/2000 | McMullin |
| 6,094,843 | A | | 8/2000 | Curley, Jr. |
| D434,289 | S | | 11/2000 | McMullin |
| D434,290 | S | | 11/2000 | McMullin |
| 6,167,641 | B1 | | 1/2001 | McMullin |
| 6,209,230 | B1 | | 4/2001 | Curley, Jr. |
| 6,248,278 | B1 | | 6/2001 | Kelly |
| 6,272,774 | B1 | | 8/2001 | Kelly |
| 6,283,290 | B1 | | 9/2001 | Thompson |
| D449,431 | S | * | 10/2001 | Savoie ..... D2/962 |
| 6,305,104 | B1 | | 10/2001 | McMullin |
| D449,921 | S | | 11/2001 | McMullin |
| D450,915 | S | | 11/2001 | McMullin |
| D452,064 | S | * | 12/2001 | Savoie ..... D2/962 |
| 6,327,797 | B1 | | 12/2001 | Deacon et al. |
| 6,354,021 | B1 | * | 3/2002 | Deacon et al. ..... 36/127 |
| 6,451,242 | B2 | | 9/2002 | Kelly |
| D466,275 | S | | 12/2002 | McMullin |
| D469,246 | S | | 1/2003 | McMullin |
| 2003/0172556 | A1 | * | 9/2003 | Terashima ..... 36/134 |
| 2003/0188458 | A1 | * | 10/2003 | Kelly ..... 36/128 |

FOREIGN PATENT DOCUMENTS

| | | |
|---|---|---|
| WO | WO 91/03960 | 4/1991 |
| WO | WO 94/28750 | 12/1994 |
| WO | WO 97/18724 | 5/1997 |
| WO | WO 98/35575 | 8/1998 |
| WO | WO 01/54527 A1 | 8/2001 |
| WO | WO 01/54528 A1 | 8/2001 |

* cited by examiner

INDEXABLE SHOE CLEAT WITH IMPROVED TRACTION

BACKGROUND OF THE INVENTION

1. Technical Field

The present invention pertains to cleats for use with shoes worn on turf and other surfaces. In particular, the present invention pertains to a golf cleat that provides traction on various types of surfaces and for specific purposes.

2. Discussion of Related Art

The need for providing improved traction elements for the soles of shoes on turf surfaces is well known in the art, particularly in the field of sports such as football, baseball, soccer and golf. In many sports, particularly golf, the need for providing improved traction elements must be considered in combination with limiting the wear and tear on the playing turf that can be caused by the traction elements.

In recent years, there has been a change from using penetrating metal spikes for golf shoes to removable plastic cleats that are much more turf-friendly and less harmful to clubhouse floor surfaces. However, the challenge with utilizing plastic cleats is to design a cleat having suitable traction on turf surfaces while being suitably protected from wear and tear due to contact with hard surfaces such as asphalt or concrete.

An example of a removable plastic cleat having desirable traction characteristics is described and illustrated in U.S. Pat. No. 6,167,641 (McMullin), the disclosure of which is incorporated herein by reference in its entirety. In the McMullin patent there is disclosed a removable cleat having a hub with an upper surface facing the shoe sole and a bottom surface facing away from the sole. A hub attachment member extends from the upper surface for attaching the hub to one of plural sole-mounted attachment means. Traction elements extend outwardly and downwardly from the hub, each traction element being deflectably attached to the hub so that it pivotally and resiliently deflects toward the sole when it encounters a hard surface. When used on grass or turf, the traction element deflection results in grass blades being trapped between the upper surface of the traction elements and the sole of the shoe, thereby grabbing the grass blades and providing the desired traction function. In addition, the deflection serves to minimize abrasive wear of the traction elements on hard surfaces such as golf paths. Importantly, the traction elements do not penetrate the surface on which they are used, thereby minimizing damage to the turf. Although this cleat is effective for the purpose described, improvements are desirable in certain aspects of the cleat performance. For example, on hard surfaces such as found in a tee box, dirt path, concrete, asphalt, tile, etc., the deflecting traction elements provide only minimal, if any, traction since each traction element is designed to spread and flex on the ground surface.

Another removable plastic cleat for golf shoes is disclosed in published PCT application WO 01/54528 of Japana Co., LTD. The Japana golf shoe cleat includes a plurality of long and short legs protruding outwardly from a body of the cleat to contact a turf surface when connected to the sole of a shoe. The long legs and short legs are disposed along a periphery of the cleat body in an alternating configuration, where one or more long legs are provided between two adjacent short legs. The long legs are designed to provide traction on turf whereas the short legs press down hard on the grass and chiefly support the weight bearing on the cleat. The Japana publication is limited in that it only discloses symmetrically alternating long and short legs extending from the shoe sole. Thus, the axially symmetric Japana cleat is not capable of being indexed or oriented in specific or selected different positions with respect to the shoe sole. That is, the Japana cleat cannot be selectively positioned such that the weight bearing shorter legs and the penetrating longer legs in different alignments based upon cleat applications requiring different directions and levels of traction.

It is therefore desirable to provide a cleat that minimizes damage to turf surfaces yet provides suitable traction for the shoe on harder surfaces as well as different levels of traction at different portions of the shoe based upon selected orientations of the shoe cleat with respect to the shoe sole.

OBJECTS AND SUMMARY OF THE INVENTION

Therefore, in light of the above, and for other reasons that become apparent when the invention is fully described, an object of the present invention is to provide a shoe cleat with enhanced traction while minimizing damage to turf surfaces.

It is another object of the present invention to provide a shoe cleat that does not easily wear on hard surfaces such as concrete or asphalt yet provides a suitable level of traction for such hard surfaces.

It is a further object of the present invention to provide a shoe cleat that is indexable to facilitate a variety of orientations of the cleat with respect to the shoe sole.

The aforesaid objects are achieved individually and in combination, and it is not intended that the present invention be construed as requiring two or more of the objects to be combined unless expressly required by the claims attached hereto.

In accordance with the present invention, a cleat securable to a receptacle disposed in a sole of a shoe includes a hub with an exposed surface facing away from the shoe sole when the cleat is secured to the shoe, at least one traction element extending from the hub in a direction away from the exposed surface of the hub, and a cleat connector extending from a surface of the hub opposing the exposed surface and securable within the receptacle of the shoe. The cleat connector is further positioned on the hub such that the radial distance defined between the hub perimeter and a central axis of the cleat connector differs at varying locations along the hub perimeter. Preferably, the hub includes an irregular geometry (e.g., a fan-shaped geometry), with a set of static and dynamic traction elements aligned along the exposed surface of the hub. The traction elements may be positioned along the hub periphery, such that the traction elements are also positioned at varying radial distances from the cleat connector central axis. Thus, the cleat connector is suitably configured to connect the cleat to the shoe sole so as to align the traction elements in a selected configuration with respect to the shoe sole based upon a particular application and/or user preference.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION OF PREFERRED EMBODIMENTS

Figure 1:
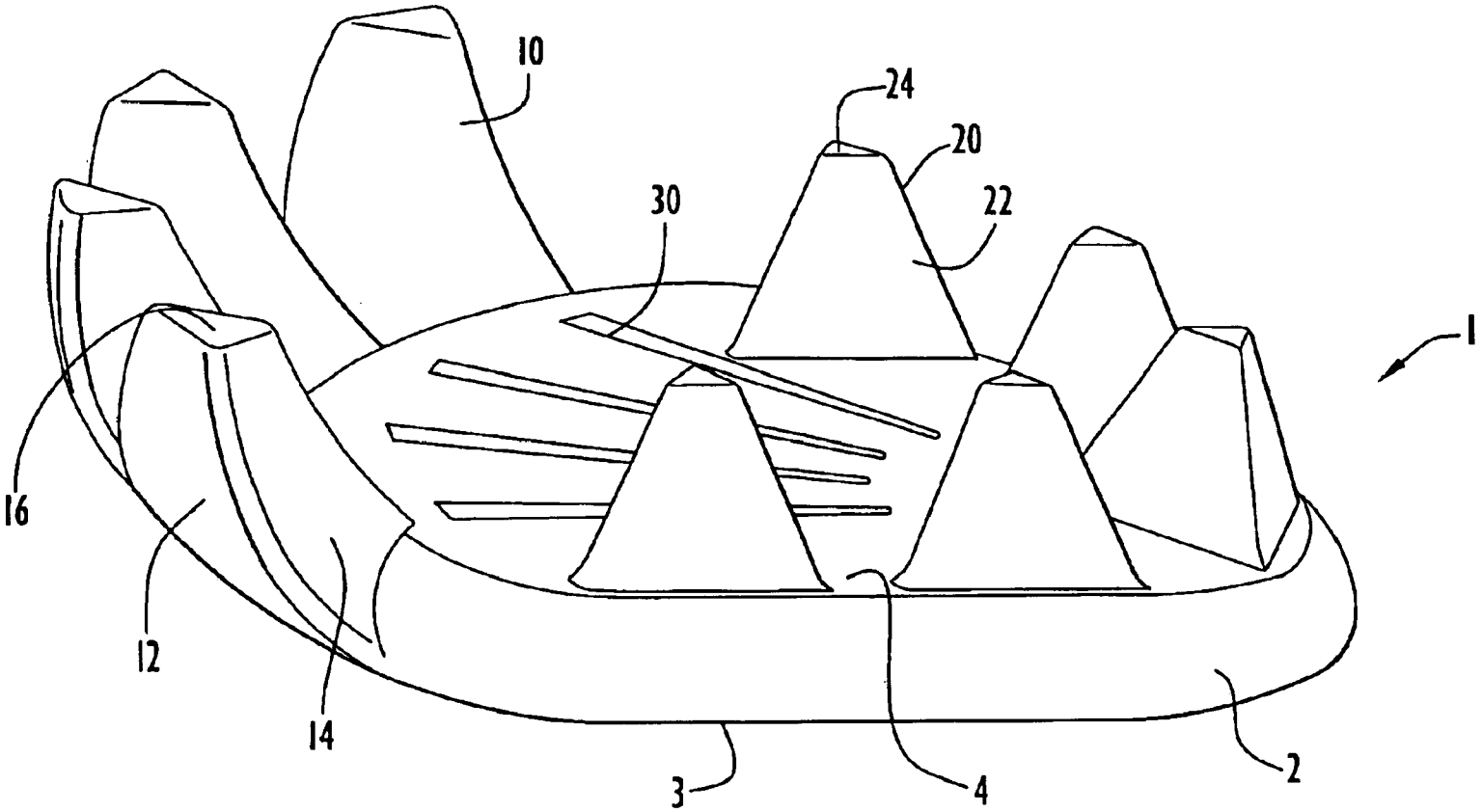
FIG. 1 is a view in perspective of an exemplary shoe cleat in accordance with the present invention.
Figure 2:
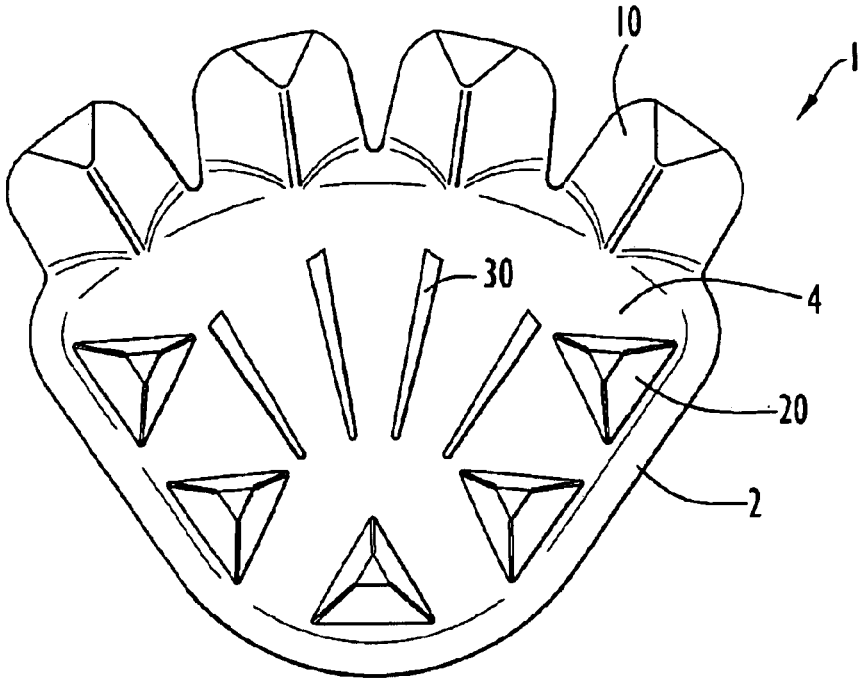
FIG. 2 is a bottom view in plan of the shoe cleat of FIG. 1.
Figure 3:
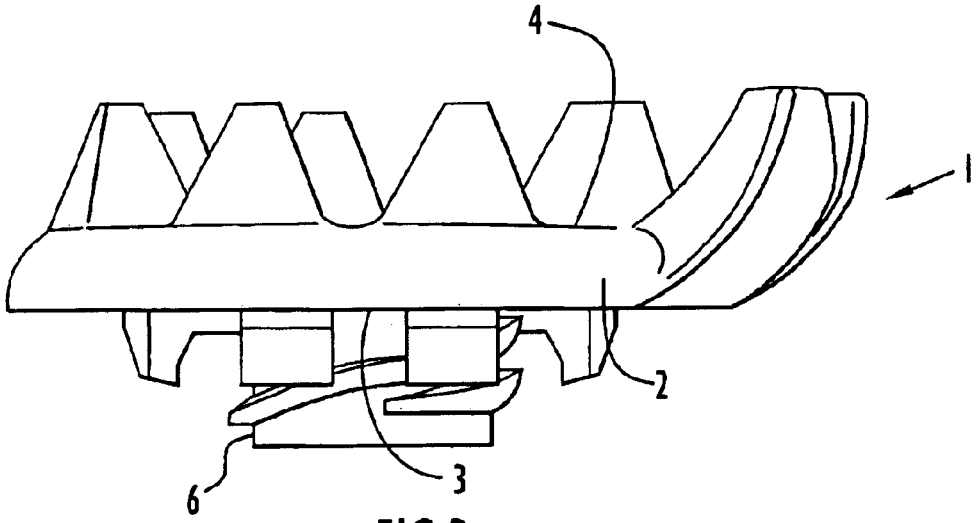
FIG. 3 is a side view in elevation of the shoe cleat of FIG. 1.

The present invention includes a cleat that is secured to a shoe sole to enhance traction of the shoe. Referring to FIGS. 1–3, shoe cleat 1 includes a non-circular, fan-shaped hub 2 having a top surface 3 and a bottom surface 4. It is to be understood that the terms "top surface" and "bottom surface" as used herein refer to surfaces of the shoe cleat that face toward or away, respectively, from the shoe sole. The fan-shaped hub has opposite rounded peripheral end portions of different radii of curvature. Specifically, the wider or peripherally longer arcuate end portion of the hub has a greater radius of curvature in comparison to the opposite narrower or peripherally shorter arcuate end portion. The peripheral sides of the hub diverge from respective ends of the narrow end portion and extend to respective ends of the wider end portion. However, the hub is not limited to such a configuration, and may have any suitable geometric configuration consistent with the principles described herein, including, without limitation, other irregularly shaped configurations, or regular circular, elliptical, rectangular, triangular or multi-sided configurations, etc.

The top surface of the hub may be connected to the shoe sole in any suitable manner to secure the cleat to the shoe. Preferably, the shoe cleat is removably connected to the shoe sole with a cleat connector such as the connector illustrated in FIG. 4 and described below. The cleat is preferably constructed of any one or more suitable plastic materials, including, without limitation, polycarbonates, polyamides (e.g., nylon), polyurethanes, natural or synthetic rubbers (e.g., styrene-butadiene), and other elastomeric polyolefins.

Extending generally downward from the hub, typically (but not necessarily) at the hub periphery are a plurality of each of two types of traction elements 10 and 20. The traction elements engage the ground surface when the shoe to which the cleat is attached is brought down into contact with that surface. In the disclosed embodiment the traction elements include a set of four sequentially aligned and substantially evenly spaced dynamic traction elements 10 arranged along the wider end portion of the hub and extending therefrom in a generally cantilevered manner, and a set of five sequentially aligned and substantially evenly spaced static traction elements 20 arranged along the narrower end portion of the hub. The dynamic traction elements are designed to resiliently pivot about the hub edge and deflect toward the shoe sole when the shoe forcefully engages a ground surface as described below, whereas the static traction elements remain substantially rigid and are resistant to deflection upon engaging the ground surface.

As can be seen in FIG. 2, the traction elements are spaced along the fan-shaped hub which generally resembles an animal's paw, with the dynamic traction elements resembling claws of the paw. Alternatively, the traction elements may be aligned along the periphery and/or other portions of the hub bottom surface in any selected manner, with traction elements being separated by any selected spacing distance (e.g., even or uneven spacing). Likewise, the traction elements may be arranged in any selected number of sets, including disposing any selected number of traction elements in selected orientations on the cleat. The selection of a specific cleat design, including a selected number of each type of traction element, as well as a selected orientation of the traction elements in sets on the hub, depends upon specific applications in which the cleat will be utilized and the type, amount and direction of traction that is desired for that application.

Each dynamic traction element 10 extends from the hub edge at the wider end portion of hub 2, curving slightly outward and away from the hub bottom surface to a terminal end of that element that is spaced a selected distance below the hub. The transverse cross-section of each dynamic traction element 10 is approximately triangular with generally concave inward sides and a convex outwardly facing side. In particular, each element 10 includes an outer surface that is rounded in a slightly convex manner, both longitudinally and transversely of element 10. Two rounded side surfaces 14 are slightly concave, both transversely and longitudinally. The side surfaces 14 diverge transversely from a common curved lineal intersection to respective longitudinal edges of outer surface 12. A generally triangular shaped transverse surface or foot 16 defines the distal terminus or end of element 10 and is defined by the distal ends of surfaces 12, 14. While feet 16 are depicted as being generally planar in the figures, it is noted that the feet may have other configurations, for example a rounded and slightly convex configuration, depending upon a particular application, so as to enhance deflection of elements 10 as the resiliently flex under the weight of the wearer of the cleated shoe against a ground surface. The dynamic traction elements 10 all have substantially similar dimensions in the disclosed embodiment, and extend substantially the same distance downward from hub 2 so that feet 16 reside in and define a transverse plane (i.e., a plane that is generally parallel to the bottom surface of the hub).

Static traction elements 20 each extend from bottom surface 4 at respective locations adjacent the narrower end portion of the hub. Elements 20 have a truncated three-sided pyramidal configuration with the truncated smaller end projecting downward from the hub. Specifically, each element 20 includes three generally planar side surfaces 22 intersecting at respective lineal edges. The element tapers downwardly and terminates in a generally planar transverse surface or foot 24. Foot 24 has a general triangular configuration geometrically similar to the transverse cross-section of element 20. However, it is noted that the feet of the static traction elements may have any selected geometric configuration and may also have a rounded, slightly convex configuration to provide various degrees of traction for the cleat for particular purposes.

The static traction elements 20 have substantially similar dimensions, with their feet 24 all residing in and defining a plane that is generally parallel to the bottom surface of the hub. That plane is also generally parallel to the plane defined by feet 16 of the dynamic traction elements 10 but resides closer to hub 2. Accordingly, in the preferred embodiment of the invention, the static traction elements 20 are all shorter in their vertical projections than the vertical projections of dynamic traction elements 10. The static elements are also shorter in overall length, irrespective of any projection plane, than the dynamic elements. It is noted that the dimensions and/or materials of construction of static traction elements 20 are selected to prevent or substantially resist deflection of the static traction elements when the cleat engages a ground surface.

Optionally, the bottom surface of the hub may include raised surface sections to enhance traction while reducing wear of the hub when the dynamic elements are flexed toward the shoe sole as the shoe engages a ground surface. Referring to the figures, cleat 1 includes a number of raised linear surface portions or ribs 30 extending along the bottom surface 4 of hub 2 between the narrower end portion and the wider end portion of the hub, with the transverse dimensions of the ribs increasing in width toward the wider end of the hub. The ribs 30 also diverge relative to one another in a direction toward the hub wider end of the hub, with each rib extending from a common arc at one end generally toward a respective dynamic traction element 10. In addition to enhancing traction and protecting the hub bottom surface during use of the cleat, the ribs are further generally oriented to enhance the aesthetic appearance of the cleat to further resemble an animal paw.

A precise orientation of the cleat with respect to a shoe sole is facilitated with an indexable cleat connector 6 such as the type illustrated in FIG. 3. Cleat connector 6 extends transversely from the top surface 3 of the hub and is configured to releasably engage with a recess or receptacle disposed in the sole of a shoe. An exemplary embodiment of a cleat connector suitable for facilitating indexing and securing of a cleat to a shoe sole is a rotary cleat connector described in U.S. Patent Application Publication No. US2002/0056210 to Kelly et al., the disclosure of which is incorporated herein by reference in its entirety. This form of cleat connector secures the cleat to the shoe by twisting the cleat connector within a receptacle of the shoe sole to a locked position. However, it is noted that any other suitable cleat connector may be utilized to orient the traction elements of the cleat in any desired manner with respect to the shoe cleat in accordance with the present invention. For example, a cleat connector that provides a non-rotary, snap-fit connection in one or more orientations with respect to a receptacle of a shoe is also suitable for use with the cleat of the present invention.

Figure 4:
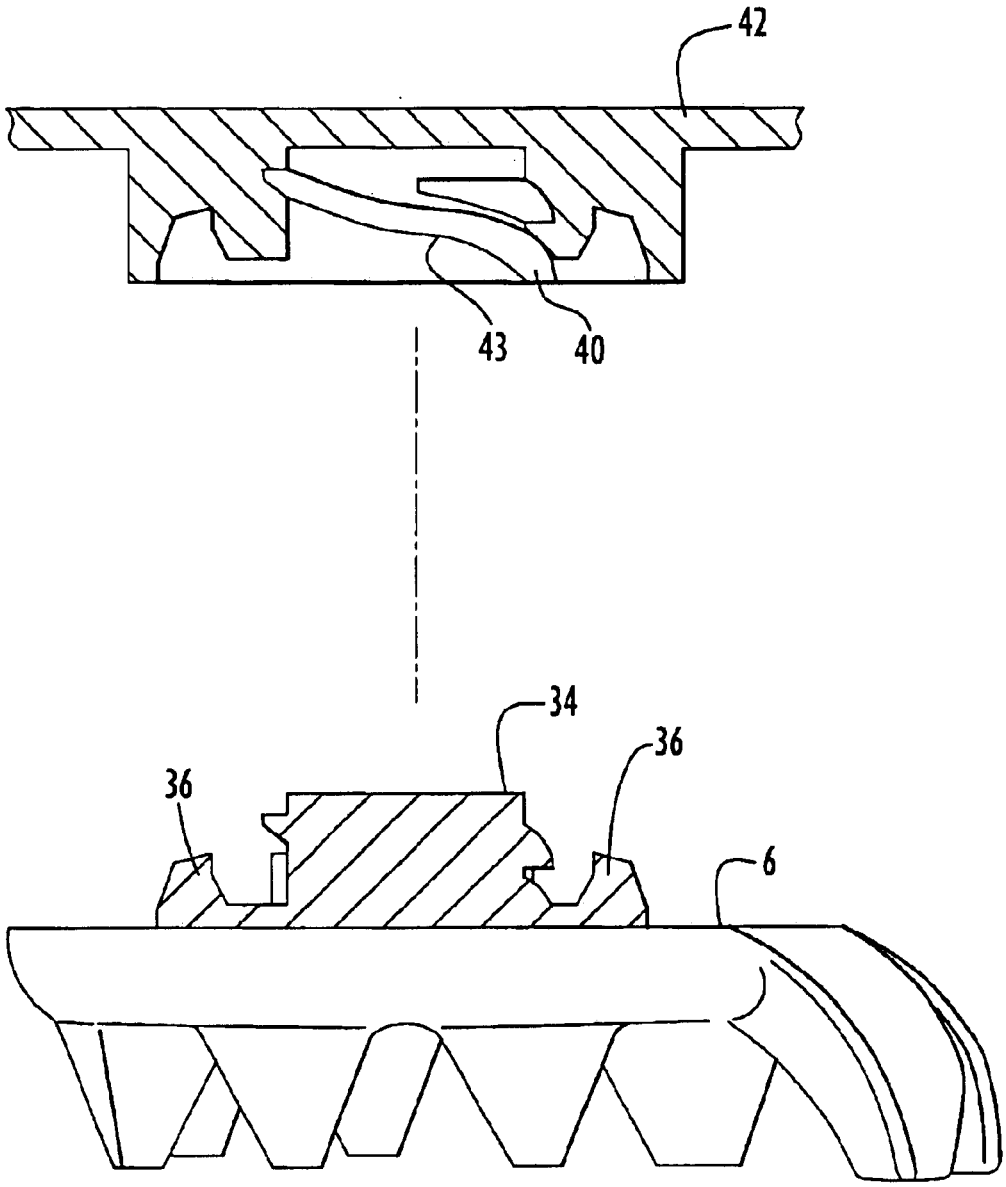
FIG. 4 is an elevated side view in partial section of the shoe cleat of FIG. 1 including a cleat connector and a connection member that engages with the cleat connector.

Referring to FIG. 4, cleat connector 6 includes an externally threaded spigot 34 as well as additional projections 36 that align and engage with an internally threaded recess 43 and other corresponding elements disposed within a receptacle 40 of the shoe sole 42 as described in the Kelly et al. published application. As further described in Kelly et al., the cleat connector and receptacle elements appropriately engage with each other by twisting the cleat connector within the receptacle to a locked position, which in turn aligns the hub of the cleat in a specific orientation with respect to the shoe sole. The cleat connector elements are suitably aligned on the hub and/or the receptacle elements are suitably aligned within the receptacle to achieve a selected orientation of the cleat traction elements with respect to the shoe sole when the cleat connector is locked within the shoe receptacle.

In operation, cleat 1 is connected to the sole of a shoe by engaging cleat connector 6 with receptacle 40 of the shoe sole and twisting the cleat connector in a suitable manner to lock the cleat to the shoe, which in turn orients the static and dynamic traction elements of the cleat in a desired alignment for a particular activity. When the weight of the user is applied to the shoe by pressing the shoe against a ground surface, dynamic traction elements 10 are the first to contact the surface. The dynamic traction elements deflect upwardly toward the shoe sole as the shoe is pressed further toward the ground surface, allowing static traction elements 20 to contact the surface when the dynamic traction elements have achieved a certain deflected orientation. Static traction elements 20 substantially maintain their original orientation and bear much of the weight applied to the shoe. When the user raises the shoe from the ground surface, the dynamic traction elements 10 resiliently flex back to their original positions.

Indexing of the cleat to achieve a desired orientation of the hub and cleat elements with respect to the shoe sole is achieved in accordance with the present invention by selecting a suitable position for the cleat connector on the hub as described below. In particular, the cleat connector is eccentrically positioned on the hub such that the radial distance defined between the hub perimeter and a central axis of the cleat connector differs at varying locations along the hub perimeter. Such eccentric positioning of the cleat connector with respect to the hub is further enhanced when an irregular hub geometry, such as the fan-shaped geometry of the cleat described above, is utilized. In particular, the combination of hub geometry, placement of the cleat connector on the hub, and/or the arrangement of the sets of static and/or dynamic traction elements on the hub may be selected to yield a cleat that is indexable in a variety of orientations with respect to the sole of a shoe to which the cleat is attached. Providing a cleat that may be indexed in certain orientations has the effect of optimizing positions for the static and dynamic traction elements on the shoe and facilitates a variety of enhanced traction effects for different applications.

For example, the irregular shaped hub geometry of cleat 1 combined with the placement of traction elements about the hub periphery and the location of the cleat connector yields a cleat with traction elements separated at varying radial distances from a central axis of the cleat connector. This in turn results in an eccentric rotation of the hub and traction elements with respect to the cleat connector central axis when the cleat connector is twisted and locked within the shoe receptacle as described above. Upon attachment to the shoe, the cleat is selectively indexed such that sets of traction elements are disposed closer to one or more sides of the shoe so as to enhance traction of the shoe for a particular use.

Figure 5:
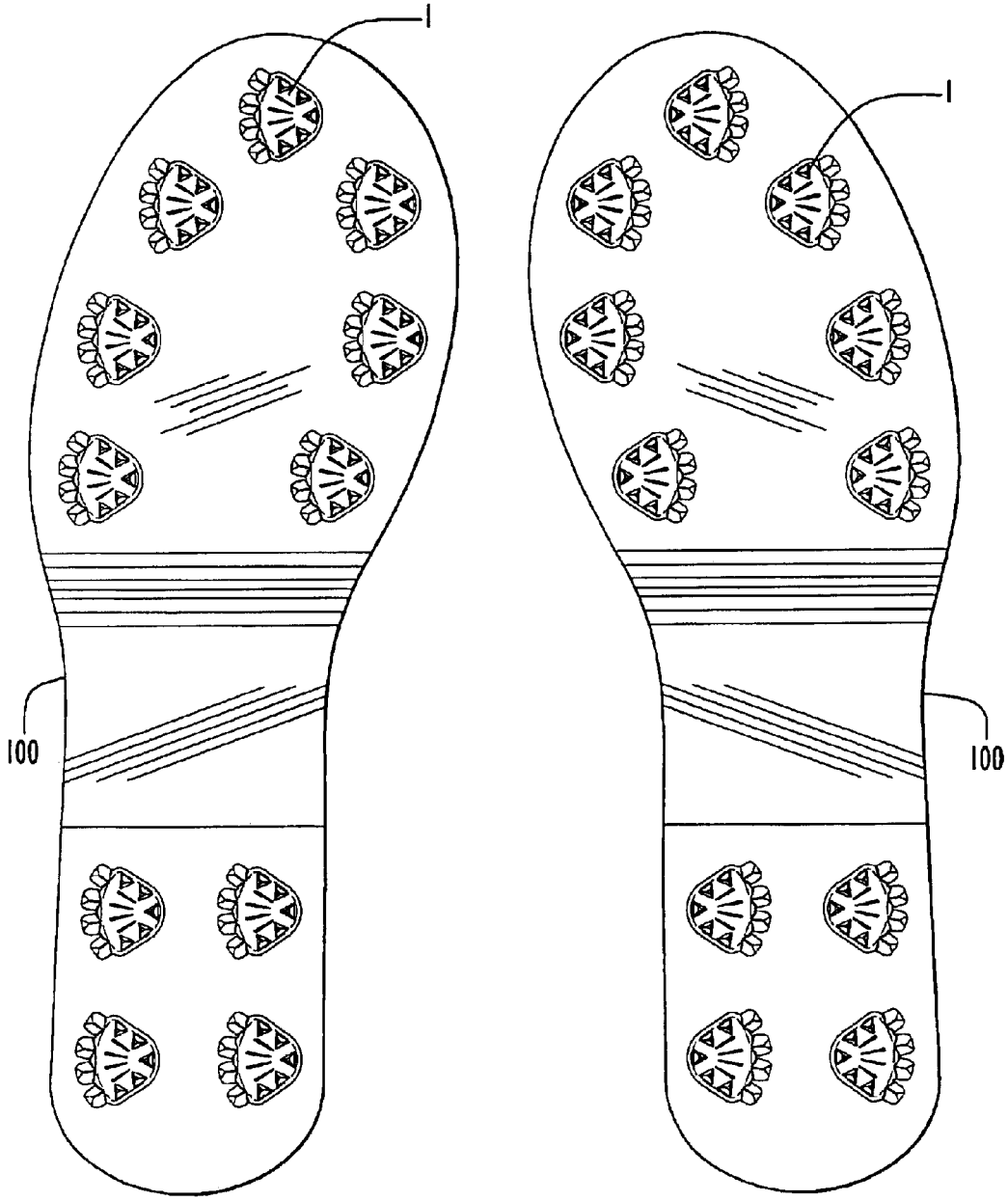
FIG. 5 is a bottom view in plan of a pair of shoes to which are secured a number of shoe cleats substantially similar to the shoe cleat of FIG. 1.

An exemplary orientation or indexing of cleats on a pair of shoes is illustrated in FIG. 5. While each shoe depicted in FIG. 5 includes a total of eleven cleats, the present invention is in no way limited to this cleat orientation or number of cleats per shoe. Rather, any suitable orientations and/or number of cleats may be provided on a shoe to provide enhanced traction for a particular application. Referring to FIG. 5, a pair of shoes 100 each includes cleats 1 that are substantially similar to the cleat described above and illustrated in FIGS. 1–4. Each cleat 1 is oriented on each shoe 100 such that its dynamic traction elements 10 generally face or point toward the outer sole perimeter of the shoe, while static traction elements 20 of each cleat generally face or point toward the inner sole perimeter of the shoe. As can be seen from FIG. 5, this cleat design facilitates the alignment of dynamic traction elements of certain cleats at a closer position to the edge of the outsole of the shoe than can be obtained with conventional cleats having a generally circular hub with cleat connector aligned at a central position on the hub and with and symmetrically oriented traction elements. This cleat orientation further provides enhanced traction for certain activities (e.g., during a golf swing) as well as enhanced stability (e.g., during walking) in comparison to conventional cleats.

As described above, the proximity to which certain traction elements may be aligned with respect to a portion of the shoe sole (e.g., the inner or outer sole perimeter) will depend upon factors such as the geometry of the hub, the placement of traction elements on the hub and the radial distance between the cleat connector and traction elements on the hub. For example, in the embodiment depicted in FIG. 5, in which it is desirable to align the dynamic traction elements of certain cleats in close proximity with the outer sole perimeter of the shoe, placement of the cleat connecter at a region on the hub that is closer in radial distance to the static traction elements than the dynamic traction elements (e.g., at or near the lower peripheral portion of the hub) will result in the dynamic traction elements of certain cleats extending closer toward the outer shoe sole when indexed in the orientation depicted in FIG. 5. Alternatively, a cleat may also be designed with the static traction elements further in radial distance from the cleat connector central axis in comparison to the dynamic traction elements so as to facilitate a close alignment of static traction elements with peripheral portions of the shoe sole.

Other hub geometries, such as circular, square, triangular, elliptical, etc., can also be utilized for a cleat in accordance with the present invention. For example, when utilizing a circular hub geometry with two or more sets of static and traction elements disposed along the periphery of the hub, a cleat connector may be situated at an eccentric location on the hub (i.e., at a selected distance from the center of the hub) such that the radial distance from the hub periphery to the cleat connector central axis will differ at different peripheral positions along the hub. In this arrangement, even when traction elements are aligned symmetrically with respect to the hub central axis, the cleat is still indexable with respect to a shoe sole as a result of the eccentric mounting of the cleat connector to the circular hub. If, for example, traction elements are aligned along the periphery of the circular hub, some traction elements will be closer in radial distance to the cleat connector central axis than other traction elements.

It will be appreciated that the embodiments described above and illustrated in the drawings represent only a few of the many ways of implementing an indexable cleat with improved traction in accordance with the present invention.

For example, the cleat may include any number (e.g., one) of static and/or dynamic traction elements disposed in any suitable manner along the bottom surface of the cleat hub. Preferably, the cleat includes static and dynamic traction elements arranged in two or more sets on the hub. The traction elements may have any suitable geometric configuration and may be constructed of any suitable materials that allow the dynamic traction elements to deflect and the static traction elements to substantially resist deflection when engaging a ground surface. Similarly, the hub may be constructed of any suitable materials and have any suitable geometric configuration (e.g., circular, square, elliptical, triangular, etc.).

The cleat may include any number of dynamic traction elements having a longitudinal dimension that is greater, smaller or substantially similar to a longitudinal dimension of any number of static traction elements on the cleat. It should also be noted that the static traction elements may be structurally identical throughout their lengths to the corresponding length portions of the dynamic traction elements; that is, the added length of the dynamic elements is what imparts the flexibility to the element and permits it to function as a dynamic traction element. It will be appreciated that flexibility need not be imparted by added length but instead may result for cross-sectional configuration or the material employed.

The cleat may be removably or non-removably secured to the shoe sole. Any suitable cleat connector may be utilized to removably secure the cleat to the shoe in any selected orientation. The cleat connector may include a single connecting member or a series of connecting members that combine to secure the cleat to the shoe sole. It is to be understood that, when a cleat connector includes two or more connecting members, the central axis of the cleat connector is disposed at the geometric center defined by the combination of connecting members forming the cleat connector. Any number of cleats may be combined in any number of suitable orientations to provide enhanced traction for a particular user and/or a particular activity.

Having described preferred embodiments of indexable shoe cleats with improved traction, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. An indexable cleat securable to the sole of a shoe for providing traction for the shoe on a ground surface, the cleat comprising:

a hub with an exposed surface facing away from the shoe sole when the cleat is secured to the shoe;

at least one traction element extending from the hub in a direction away from the exposed surface of the hub; and a cleat connector extending from a surface of the hub opposing the exposed surface and securable within a receptacle of the shoe;

wherein the cleat connector includes a central axis that is eccentrically aligned with respect to the hub to facilitate different orientations of the hub with respect to the shoe sole when the cleat is secured to the shoe;

wherein the hub includes opposing wider and narrower rounded peripheral portions, the wider peripheral portion having a radius of curvature and arcuate length that are greater than a radius of curvature and arcuate length of the narrower peripheral portion.

2. The cleat of claim 1, further comprising:

elongated ribs extending from the exposed surface of the hub.

3. The cleat of claim 1, further comprising:

at least one dynamic traction element extending from the hub in a direction away from the exposed surface of the hub, the dynamic traction element being configured to deflect toward the shoe sole when the shoe to which the cleat is secured engages the ground surface; and at least one static traction element extending from the hub in a direction away from the exposed surface of the hub, the static traction element being configured to substantially resist flexing when the shoe to which the cleat is secured engages the ground surface.

4. The cleat of claim 3, wherein the dynamic traction element is greater in longitudinal dimension and projects vertically farther from the hub than the static traction element.

5. The cleat of claim 3, further comprising:

at least one set of dynamic traction elements consecutively aligned along a first peripheral portion of the hub; and at least one set of static traction elements consecutively aligned along a second peripheral portion of the hub.

6. The cleat of claim 1, wherein the cleat connector includes a threaded member that is secured within the receptacle by inserting the threaded member within the receptacle and twisting the cleat connector to a locked position with respect to the receptacle.

7. A shoe for providing traction on a around surface, the shoe comprising:

a sole including at least at least one receptacle; and at least one cleat secured to the shoe sole via the receptacle, the cleat comprising:

a hub with an exposed surface facing away from the shoe sole when the cleat is secured to the shoe;

at least one traction element extending from the hub in a direction away from the exposed surface of the hub; and a cleat connector extending from a surface of the hub opposing the exposed surface and securable within the receptacle;

wherein the cleat connector includes a central axis that is eccentrically aligned with respect to the hub to facilitate different orientations of the hub with respect to the shoe sole when the cleat is secured to the shoe;

wherein the hub includes opposing wider and narrower rounded peripheral portions, the wider peripheral portion having a radius of curvature and arcuate length that are greater than a radius of curvature and arcuate length of the narrower end portion.

8. The shoe of claim 7, further comprising:

elongated ribs extending from the exposed surface of the hub.

9. The shoe of claim 7, further comprising:

at least one dynamic traction element extending from the hub in a direction away from the exposed surface of the hub, the dynamic traction element being configured to deflect toward the shoe sole when the shoe to which the cleat is secured engages the ground surface; and at least one static traction element extending from the hub in a direction away from the exposed surface of the hub, the static traction element being configured to substantially resist flexing when the shoe to which the cleat is secured engages the ground surface.

10. The shoe of claim 9, wherein the dynamic traction element is greater in longitudinal dimension than the static traction element.

11. The shoe of claim 9, further comprising:

at least one set of dynamic traction elements consecutively aligned along a first peripheral portion of the hub; and at least one set of static traction elements consecutively aligned along a second peripheral portion of the hub.

12. The shoe of claim 7, wherein the cleat connector includes a threaded member that is secured within the receptacle by inserting the threaded member within the receptacle and twisting the cleat connector to a locked position with respect to the receptacle.

13. A method of providing traction for a shoe on a ground surface utilizing a cleat secured to a sole of the shoe, the cleat including a hub with an exposed surface facing away from the shoe sole, at least one traction element extending from the hub in a direction away from the hub exposed surface, and a cleat connector extending from a surface of the hub opposing the exposed surface and including a central axis that is eccentrically aligned with respect to the hub, the method comprising:

(a) securing the cleat connector within a receptacle of the shoe sole to attach the cleat to the shoe and selectively orient the hub with respect to the shoe sole when the cleat is secured to the shoe;

wherein the hub includes opposing wider and narrower rounded peripheral portions, the wider peripheral portion having a radius of curvature and arcuate length that are greater than a radius of curvature and arcuate length of the narrower peripheral portion, and (a) includes:

(a.1) securing the cleat connector within the receptacle to selectively orient one of the opposing wider and narrower rounded peripheral portions of the hub with respect to a peripheral portion of the shoe sole.

14. The method of claim 13, wherein the cleat further includes at least one dynamic traction element and at least one static traction element extending from the hub in a direction away from the exposed surface of the hub, and the method further comprises:

(b) forcing the shoe against the ground surface; and (c) in response to the forcing of the shoe against the ground surface, resiliently deflecting the dynamic traction element from an initial position toward the shoe sole while the static traction element substantially resists flexing.

15. The method of claim 14, further comprising:

(d) removing the shoe from the ground surface; and (e) in response to removal of the shoe from the ground surface, deflecting the traction element back to the initial position.

16. The method of claim 15, wherein the dynamic traction element is greater in longitudinal dimension than the static traction element.

17. The method of claim 15, wherein the cleat further includes at least one set of dynamic traction elements consecutively aligned along a first peripheral portion of the hub and at least one set of static traction elements consecutively aligned along a second peripheral portion of the hub.

18. The method of claim 13, wherein the cleat wherein the cleat connector includes a threaded member, and (a) further comprises:

(a.1) securing the cleat connector within the receptacle by inserting the threaded member within the receptacle and twisting the cleat connector to a locked position with respect to the receptacle.

* * * * *